US010760558B2

(12) United States Patent
Fallah et al.

(10) Patent No.: US 10,760,558 B2
(45) Date of Patent: Sep. 1, 2020

(54) MULTISTAGE COMPRESSOR WITH MAGNETICALLY ACTATED COMPRESSION STAGE

(71) Applicant: Kavan Novin Energy Paydar Group, Oroumieh (IR)

(72) Inventors: Abdolreza Fallah, Tehran (IR); Shapour Faridi, Oroumieh (IR)

( * ) Notice: Subject to any disclaimer, the term of this patent is extended or adjusted under 35 U.S.C. 154(b) by 359 days.

(21) Appl. No.: 15/704,994

(22) Filed: Sep. 14, 2017

(65) Prior Publication Data

US 2018/0003165 A1 Jan. 4, 2018

Related U.S. Application Data

(60) Provisional application No. 62/394,412, filed on Sep. 14, 2016.

(51) Int. Cl.

| | |
|---|---|
| ***F04B 25/04*** | (2006.01) |
| ***F04B 41/06*** | (2006.01) |
| ***F04B 35/04*** | (2006.01) |
| ***F04B 53/10*** | (2006.01) |
| ***F04B 45/02*** | (2006.01) |
| ***F04B 45/027*** | (2006.01) |

(52) U.S. Cl.

CPC ..... *F04B 25/04* (2013.01); *F04B 35/04* (2013.01); *F04B 41/06* (2013.01); *F04B 45/022* (2013.01); *F04B 45/027* (2013.01); *F04B 53/1047* (2013.01)

(58) Field of Classification Search

CPC ..... F04B 25/04; F04B 45/027; F04B 45/022; F04B 53/1047; F04B 35/04; F04B 41/06

See application file for complete search history.

(56) References Cited

U.S. PATENT DOCUMENTS

| | | | | |
|---|---|---|---|---|
| 5,632,607 A * | 5/1997 | Popescu | F04B 43/026 | 417/415 |
| 6,840,923 B1 * | 1/2005 | Lapcevic | A61F 5/442 | 604/319 |
| 2007/0196216 A1 * | 8/2007 | Almaraz | F04B 25/04 | 417/266 |

(Continued)

*Primary Examiner* — Essama Omgba
*Assistant Examiner* — Stephen A Mick
(74) *Attorney, Agent, or Firm* — Bajwa IP Law Firm; Haris Zaheer Bajwa

(57) ABSTRACT

A multistage compressor is disclosed that may include a wobbling member operationally coupled with an external power source. The external power source may drive a nutating motion of the wobbling member. The multistage compressor may further include a plurality of flexible chambers connected to the wobbling member, each flexible chamber including a respective intake passage and a respective discharge passage. The wobbling member may sequentially press down and pull up the plurality of flexible chambers. The multistage compressor may further include a one-way valve in each respective intake passage and gas may be drawn into each flexible chamber through the respective one-way valve of each flexible chamber as the wobbling member pulls up each flexible chamber. The gas may then be compressed to a higher pressure as the wobbling member presses down each flexible chamber and compressed gas may be discharged through the respective discharge passage of each flexible chamber.

11 Claims, 10 Drawing Sheets

(56) References Cited

U.S. PATENT DOCUMENTS

| | | | | |
|---|---|---|---|---|
| 2011/0020159 | A1* | 1/2011 | Kuttler | F04B 7/0076<br>417/505 |
| 2015/0337826 | A1* | 11/2015 | Cai | F04B 45/027<br>417/472 |

* cited by examiner

MULTISTAGE COMPRESSOR WITH MAGNETICALLY ACTATED COMPRESSION STAGE

CROSS-REFERENCE TO RELATED APPLICATION

This application claims the benefit of priority from U.S. Provisional Patent Application Ser. No. 62/394,412, filed on Sep. 14, 2016, and entitled "MULTISTAGE SILICONE COMPRESSOR," which is incorporated herein by reference in its entirety.

TECHNICAL FIELD

The present disclosure generally relates to compressors, particularly to multistage compressors, and more particularly to oil-free compressors.

BACKGROUND

Conventional compressors have various disadvantages, particularly when it comes to applications, such as gas compression for medical use. For example, relatively large, heavy, noisy and inefficient compressors are not suitable for medical applications where using oil is prohibited in the gas compression systems. Furthermore, in areas such as dental clinics and hospitals, quiet gas compressors are preferable. There is, therefore, a need in the art for quiet compressors with simple oil-free designs without relatively complicated timing and valve connections.

SUMMARY

This summary is intended to provide an overview of the subject matter of the present disclosure, and is not intended to identify essential elements or key elements of the subject matter, nor is it intended to be used to determine the scope of the claimed embodiments. The proper scope of the present disclosure may be ascertained from the claims set forth below in view of the detailed description below and the drawings.

The present disclosure is directed to a multistage compressor that may include a wobbling member operationally coupled with an external power source. The external power source may drive a nutating motion of the wobbling member. The multistage compressor may further include a plurality of flexible chambers connected to the wobbling member, each flexible chamber including a respective intake passage and a respective discharge passage. The wobbling member may sequentially press down and pull up the plurality of flexible chambers. The multistage compressor may further include a one-way valve in each respective intake passage and gas may be drawn into each flexible chamber through the respective one-way valve of each flexible chamber as the wobbling member pulls up each flexible chamber. The gas may then be compressed to a higher pressure as the wobbling member presses down each flexible chamber and compressed gas may be discharged through the respective discharge passage of each flexible chamber.

According to some exemplary embodiments, the multistage compressor may further include a magnetically actuated compression stage that may receive the compressed gas gathered from the flexible chambers and further compress the gas to a higher pressure. The magnetically actuated compression stage may include an elongated cylinder with an inlet port and an outlet port, a bobbin disposed inside the elongated cylinder, and a reciprocating member mounted for reciprocating movement in the bobbin. The reciprocating member may include a permanent magnet and it may sealably engage an inner surface of the bobbin. The magnetically actuated compression stage may further include a controller coupled with the bobbin for sequentially changing polarity of the bobbin to generate a reciprocating magnetic field that drives the permanent magnet reciprocally through the elongated cylinder such that the compressed gas is alternatively drawn into the elongated cylinder from the inlet port and is further compressed and discharged from the outlet port.

According to an exemplary embodiment, the wobbling member may include a plurality of extended tongues, where each flexible chamber of the plurality of flexible chambers may be attached to a corresponding extended tongue of the plurality of extended tongues. According to another embodiment, the plurality of extended tongues may include three extended tongues spaced apart by 120°.

According to an exemplary embodiment, the wobbling member may include a disk and each flexible chamber of the plurality of flexible chambers may be attached to periphery of the disk. According to some exemplary embodiments, the wobbling member may include a disk, wherein three flexible chambers may be attached to periphery of the disk spaced apart by 120°.

According to an exemplary embodiment, the flexible chambers may share a flange in a form of a base plate. The one-way valve of each flexible chamber may be integrally formed on the base plate. According to an exemplary embodiment, the one-way valve of each flexible chamber may include a flexible tongue bendable in one direction, wherein the flexible tongue is cut into the base plate.

According to an exemplary embodiment, the flexible chambers, the base plate, and the one-way valves may be formed as an integrated flexible assembly out of a flexible material. According to an exemplary embodiment, the intake passage and the discharge passage of each flexible chamber may be formed on a first cap that may be attached sealably and immediately under the integrated flexible assembly. According to an exemplary embodiment, the plurality of flexible chambers may include flexible cups made of a flexible polymeric material.

Other systems, methods, features and advantages of the embodiments will be, or will become, apparent to one of ordinary skill in the art upon examination of the following figures and detailed description. It is intended that all such additional systems, methods, features and advantages be included within this description and this summary, be within the scope of the embodiments, and be protected by the following claims.

BRIEF DESCRIPTION OF THE DRAWINGS

The drawing figures depict one or more embodiments in accord with the present teachings, by way of example only, not by way of limitation. In the figures, like reference numerals refer to the same or similar elements.

DETAILED DESCRIPTION

In the following detailed description, numerous specific details are set forth by way of examples in order to provide a thorough understanding of the relevant teachings. However, it should be apparent that the present teachings may be practiced without such details. In other instances, well known methods, procedures, components, and/or circuitry have been described at a relatively high-level, without detail, in order to avoid unnecessarily obscuring aspects of the present teachings.

Disclosed herein is a multistage compressor for compressing gas or any other gaseous matters or fluids such as carbon dioxide, refrigerants and the like. For ease of reference, the gaseous fluid to be compressed is hereinafter simply referred to as gas. The multistage compressor may include a number of compression stages. In a first compression stage, the gas may be compressed in a positive displacement compressor, where the gas may be drawn in and captured in a number of flexible chambers and then a wobbling member may be utilized to reduce the volume of the flexible chambers to compress the gas from the first pressure to an intermediate pressure. In a second compression stage, the gas may be further compressed from the intermediate pressure to a second higher pressure in a magnetically actuated compression stage, where a magnetic field may be utilized to drive a permanent magnet member reciprocally inside a cylindrical chamber. Utilizing flexible chambers in combination with the wobbling member in the first compression stage and the magnetically actuated positive displacement compressor in the second compression stage may enable the disclosed multistage compressor to function as a relatively quiet and oil-free compressor, which may be suitable for applications where clean gas and/or silence are important.

Figure 1:
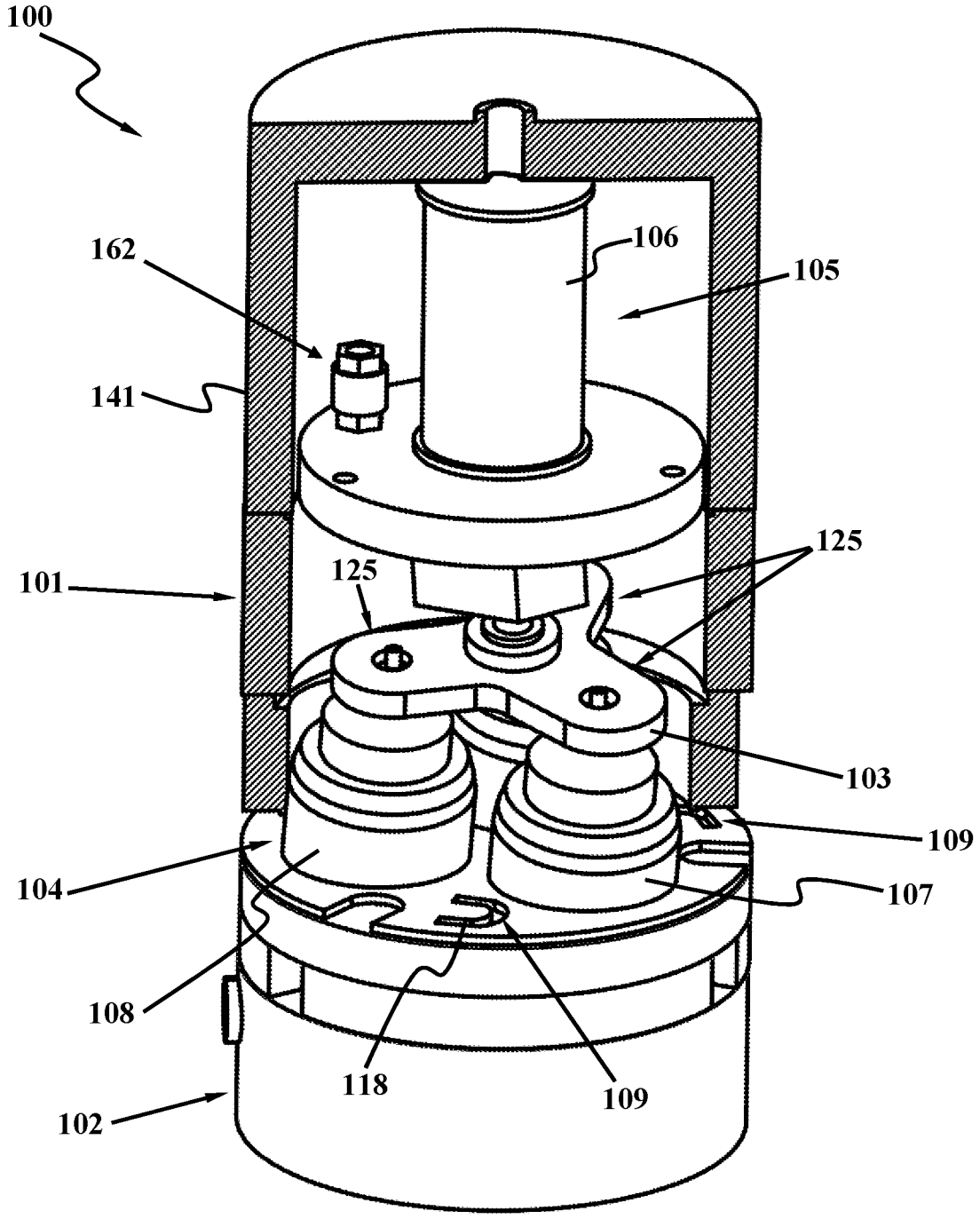
FIG. 1 illustrates a sectional perspective view of a multistage compressor, consistent with exemplary embodiments of the present disclosure.

FIG. 1 illustrates a sectional perspective view of a multistage compressor 100, consistent with one or more exemplary embodiments of the present disclosure. Multistage compressor 100 may include a first compression stage 101 and a second compression stage 102. In first compression stage 101, a wobbling member 103 is connected to a number of flexible chambers 104 that may be formed as a number of flexible polymeric cups. Wobbling member 103 may be operationally coupled with an external power source 105 that may be a mechanical source of rotary power, such as an electric motor 106. External power source 105 may drive the nutating motion of wobbling member 103 as will be described later in this disclosure. As wobbling member 103 nutates, it may transform rotational movement of electric motor 106 to a reciprocating motion through which flexible chambers 104 may be pressed down one after another and then pulled up again by wobbling member 103. Flexible chambers 104 may form expandable and collapsible compressing chambers that may be pressed down by wobbling member 103 in order to compress the gas trapped therein and may be pulled up by wobbling member 103 in order to draw the gas into flexible chambers 104. As wobbling member 103 presses down a flexible chamber, such as flexible chamber 107, available volume under flexible chamber 107 may be reduced and thereby gas trapped under flexible chamber 107 may be compressed. Compressed gas may be discharged from under each flexible chamber, such as flexible chamber 107 through a discharge passage (obscured from view in FIG. 1) under flexible chamber 107. As wobbling member 103 pulls up a flexible chamber, such as flexible chamber 108, available volume under flexible chamber 108 may be increased and gas may be sucked or drawn into flexible chamber 108 via an intake passage. Gas may be drawn in under flexible chambers 104 via the intake passages through one-way valves 109 that only allow the gas to be drawn inside flexible chambers 104. First compression stage 101 may be disposed within a first chamber 141. The gas may enter first compression stage 101 through a one-way valve 162.

Figure 2:
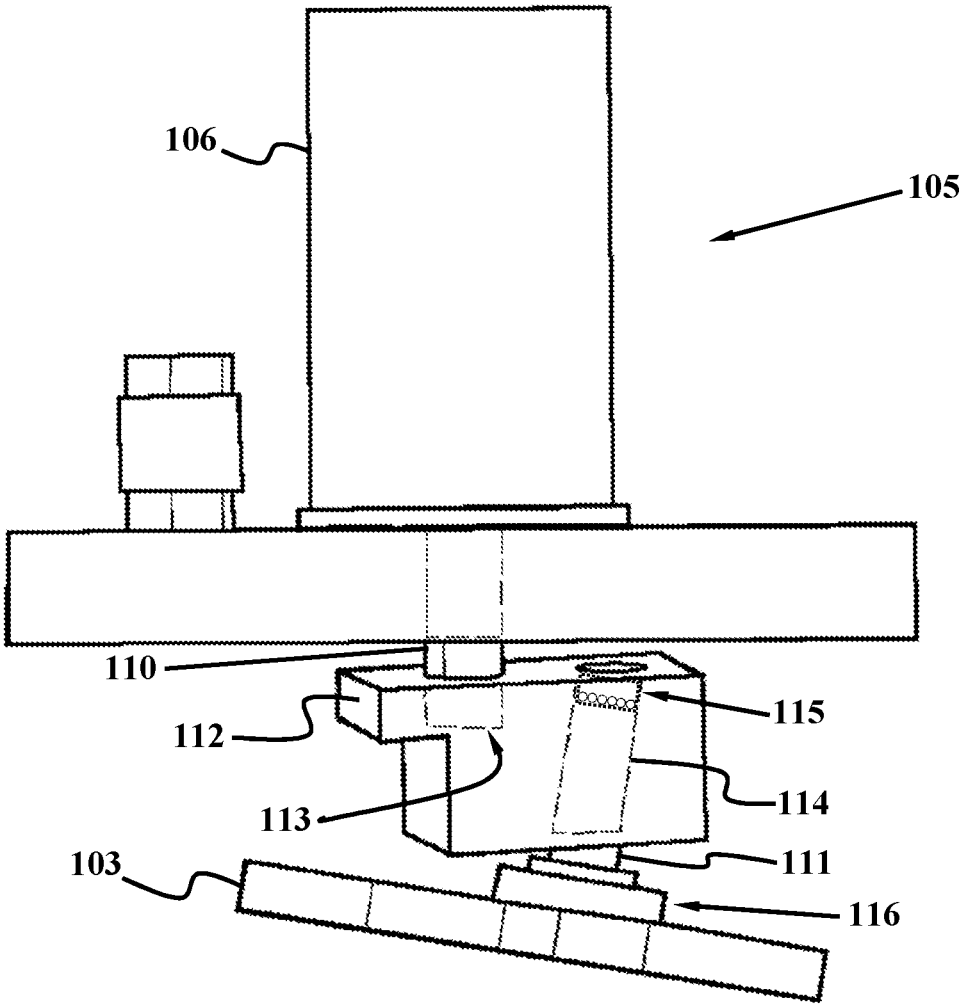
FIG. 2 illustrates a wobbling member assembly, consistent with one or more exemplary embodiments of the present disclosure.

FIG. 2 illustrates a wobbling member assembly, consistent with one or more the exemplary embodiments of the present disclosure. Wobbling member 103 may be coupled to a drive shaft 110 of electric motor 106 by a crank pin 111 that may be eccentrically coupled with drive shaft 110 by a coupling member 112. Coupling member 112 may be a crank and drive shaft 110 may be fixed inside a first receiving hole 113 of coupling member 112 by, for example a key coupling (not explicitly shown in FIG. 2). One end of crank pin 111 may be received inside a second angled receiving hole 114 of coupling member 112 and may be rotationally disposed inside second angled receiving hole 114 of coupling member 112 with at least one bearing 115. According to another embodiment, two bearings may be utilized, where the bearings are disposed from each other at a distance to provide a stable support of crank pin 111. An opposite end of crank pin 111 may be disposed on wobbling member 103 by a coupling member 116 and crank pin 111 may be key coupled with wobbling member 103. The rotational movement of electric motor 106 may be transferred to wobbling member 103 through a Z-shaped shaft that may be formed by drive shaft 110, coupling member 112 and crank pin 111. With this configuration, the rotation of drive shaft 110 by electric motor 106 causes wobbling member 103 to perform a nutating and non-rotating motion. As used herein, a nutating motion of wobbling member 103 means a wobbling motion without rotation of wobbling member 103 about its normal axis. Referring to FIG. 2, crank pin 111 may be disposed on the normal axis of wobbling member 103 and perpendicular to a plane containing wobbling member 103.

Figure 3:
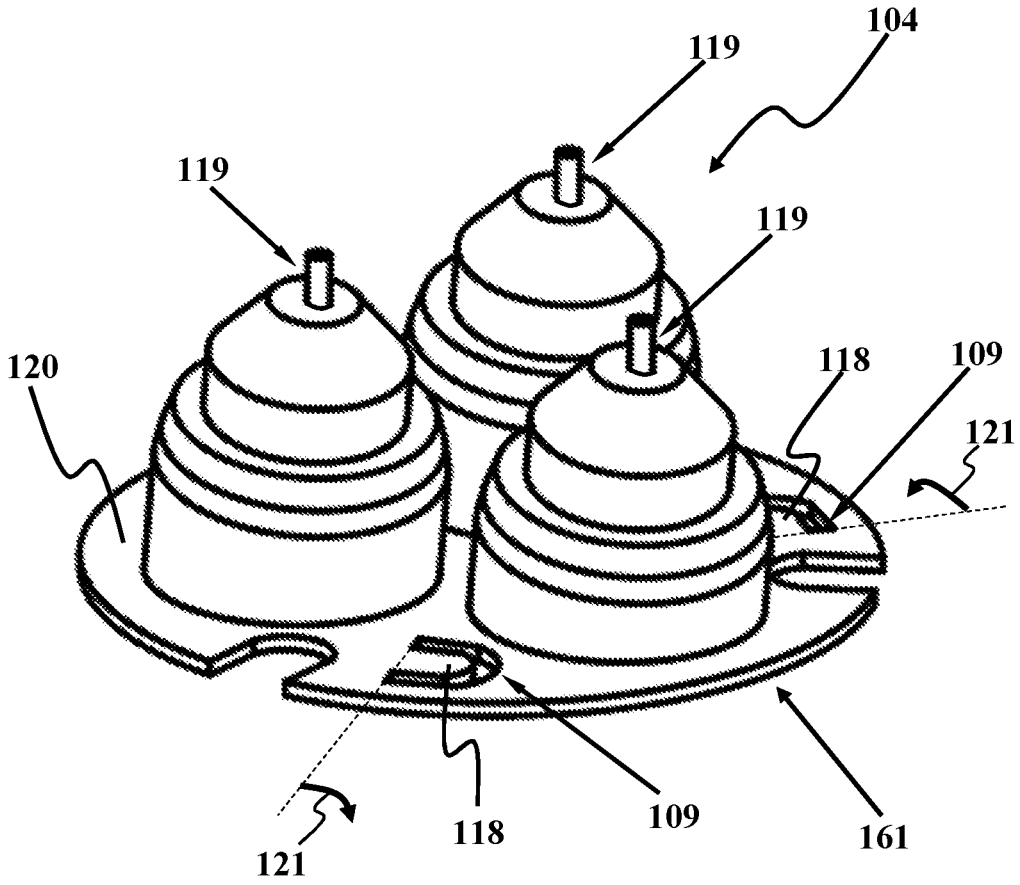
FIG. 3 illustrates a perspective view of flexible chambers, consistent with one or more exemplary embodiments of the present disclosure.

FIG. 3 illustrates a perspective view of flexible chambers 104, consistent with one or more exemplary embodiments of the present disclosure. Flexible chambers 104 may be similar in size and shape. Referring to FIG. 3, flexible chambers 104 may include flexible polymeric cups that may be, for example, made of silicone or rubber. Flexible chambers 104 may be open at their base ends and on their opposite ends, threaded rods 119 may be secured that may function as fastening members to connect flexible chambers 104 to wobbling member (not shown in FIG. 3).

Referring to FIG. 3, flexible chambers 104 may share a flange in a form of a base plate 120. One-way valves 109 (one of which is obscured from view in FIG. 3) may be formed on base plate 120. According to some embodiments, flexible chambers 104, base plate 120 and one-way valves 109 may be integrally formed as an integrated flexible assembly 163 out of a flexible material such as silicon or other flexible polymeric materials.

Referring to FIG. 3, one-way valves 109 may include flexible tongues 118 cut into base plate 120, where flexible tongues 118 may bend in one direction, for example in directions shown by arrows 121 and their bending may be prohibited in other directions, thereby forming a one-way valve which will be described later in this disclosure.

Figure 4:
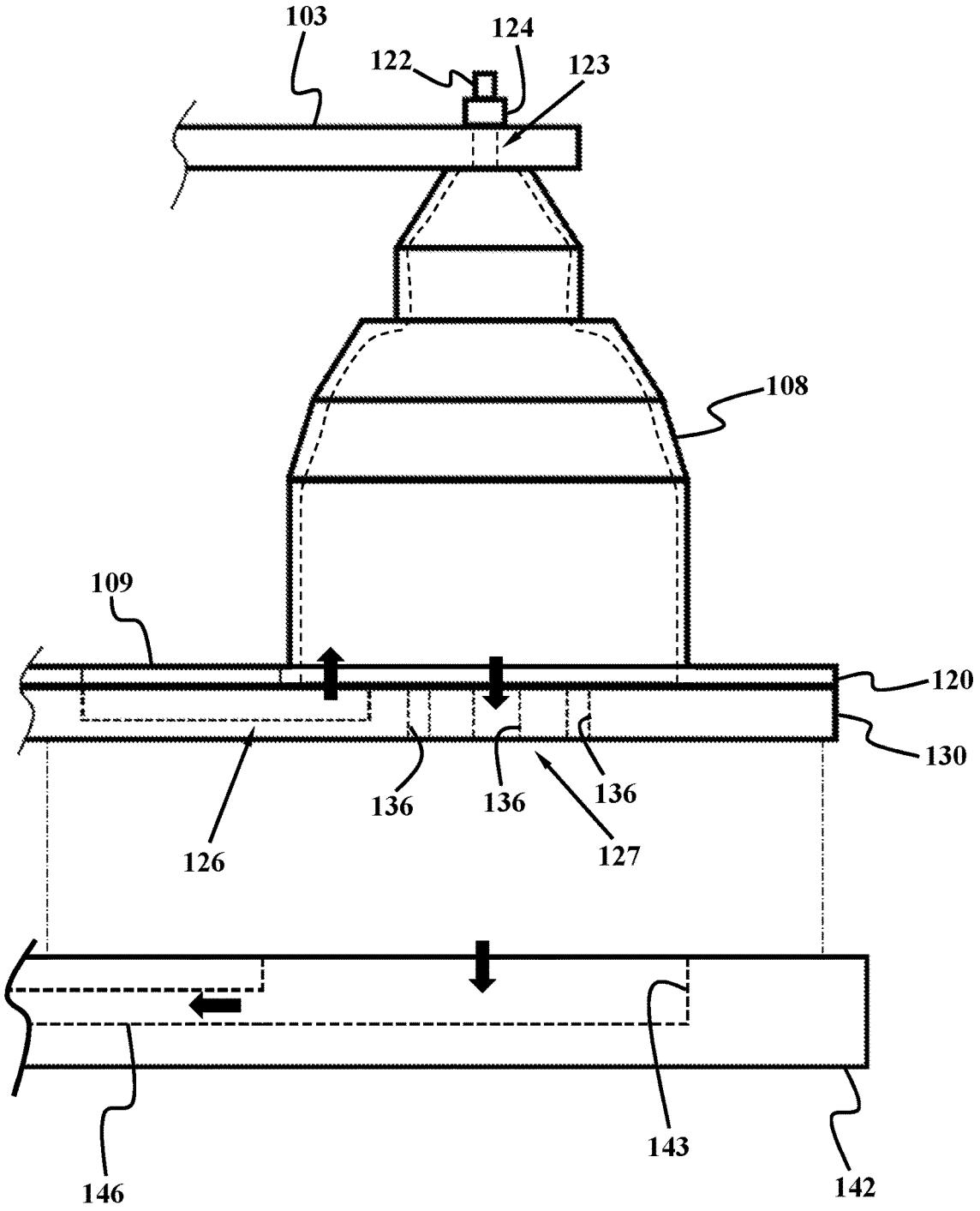
FIG. 4 is a schematic representation of a flexible chamber, consistent with one or more exemplary embodiments of the present disclosure.

FIG. 4 is a schematic representation of flexible chamber 108, consistent with one or more exemplary embodiments of the present disclosure. Referring to FIG. 4, flexible chamber 108 may be connected to wobbling member 103 via a threaded rod 122 that may be similar to any of threaded rods 119. There may be a receiving hole 123 near periphery of wobbling member 103, through which threaded rod 122 may pass and be fastened to wobbling member 103 by a fastening member 124. Referring back to FIG. 1, all flexible chambers 104 may be similarly connected to wobbling member 103.

With further reference to FIG. 1, according to some exemplary embodiments, wobbling member 103 may have three extended tongues 125, where each extended tongue has a respective receiving hole near its periphery, through which a respective flexible chamber may be fastened to the wobbling member as was described in more detail in connection with FIG. 4. Extended tongues 125 may be spaced apart by 120° and each of extended tongues 125 may be slightly curved upward. According to some embodiments, wobbling member 103 may be a disk with three spaced apart receiving holes near its edge, where the receiving holes are spaced apart by 120°.

With further reference to FIG. 4, a flexible chamber, such as flexible chamber 108 may be in gaseous fluid communication with an intake passage 126 and a discharge passage 127. Gas may be drawn into flexible chamber 108 via intake passage 126 and compressed gas may be discharged from under flexible chamber 108 via discharge passage 127.

Figure 6:
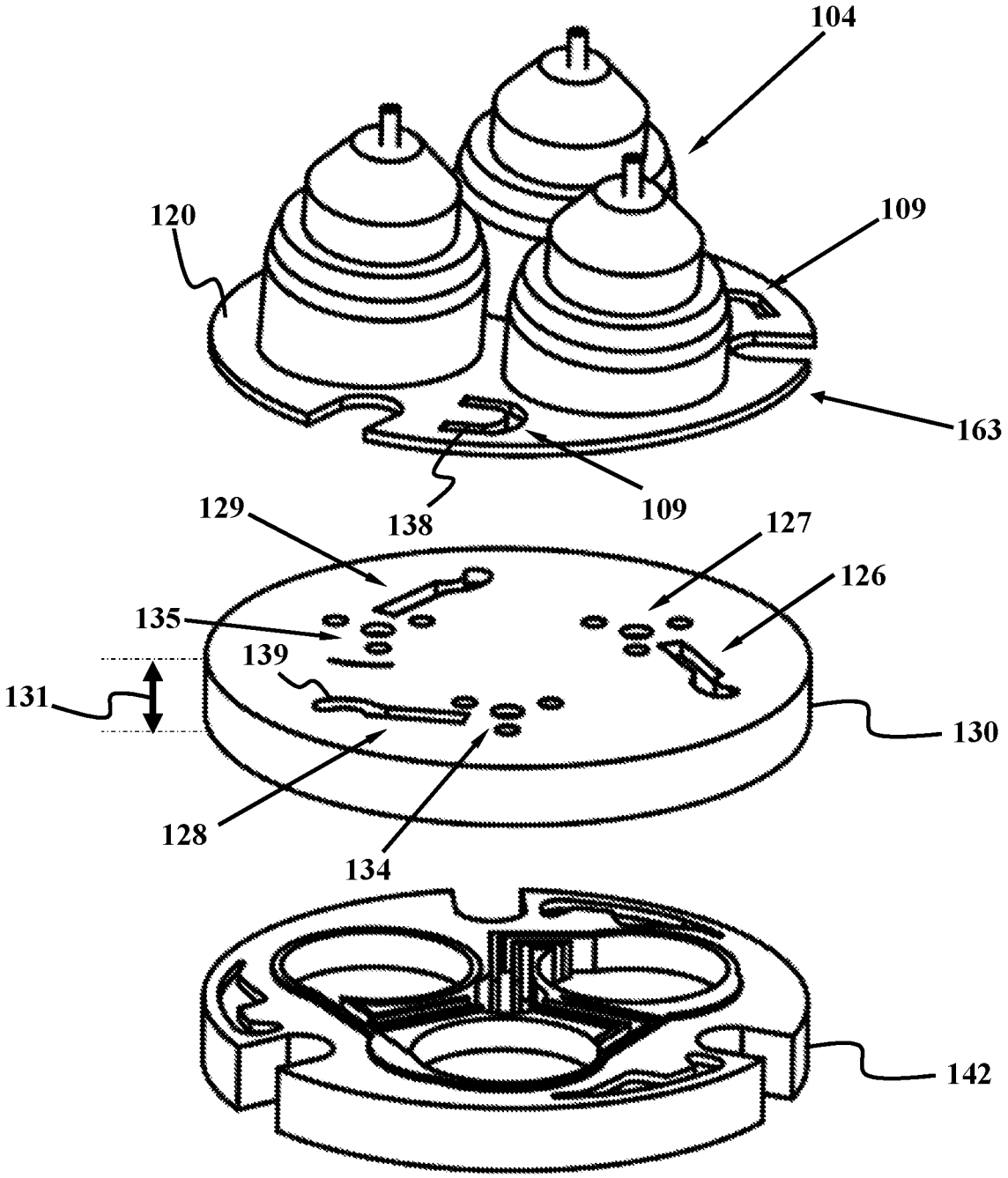
FIG. 6 illustrates an exploded view of flexible chambers, a first cap, and a guiding cap, consistent with one or more exemplary embodiments of the present disclosure.

Referring to FIG. 6, integrated flexible assembly 163 that includes integrally formed flexible chambers 104, one-way valves 109, and base plate 120 may be placed immediately above a first cap 130. Intake passages 126, 128, and 129 may be formed on first cap 130 as a number of grooves with a depth less than width 131 of first cap 130.

Figure 7:
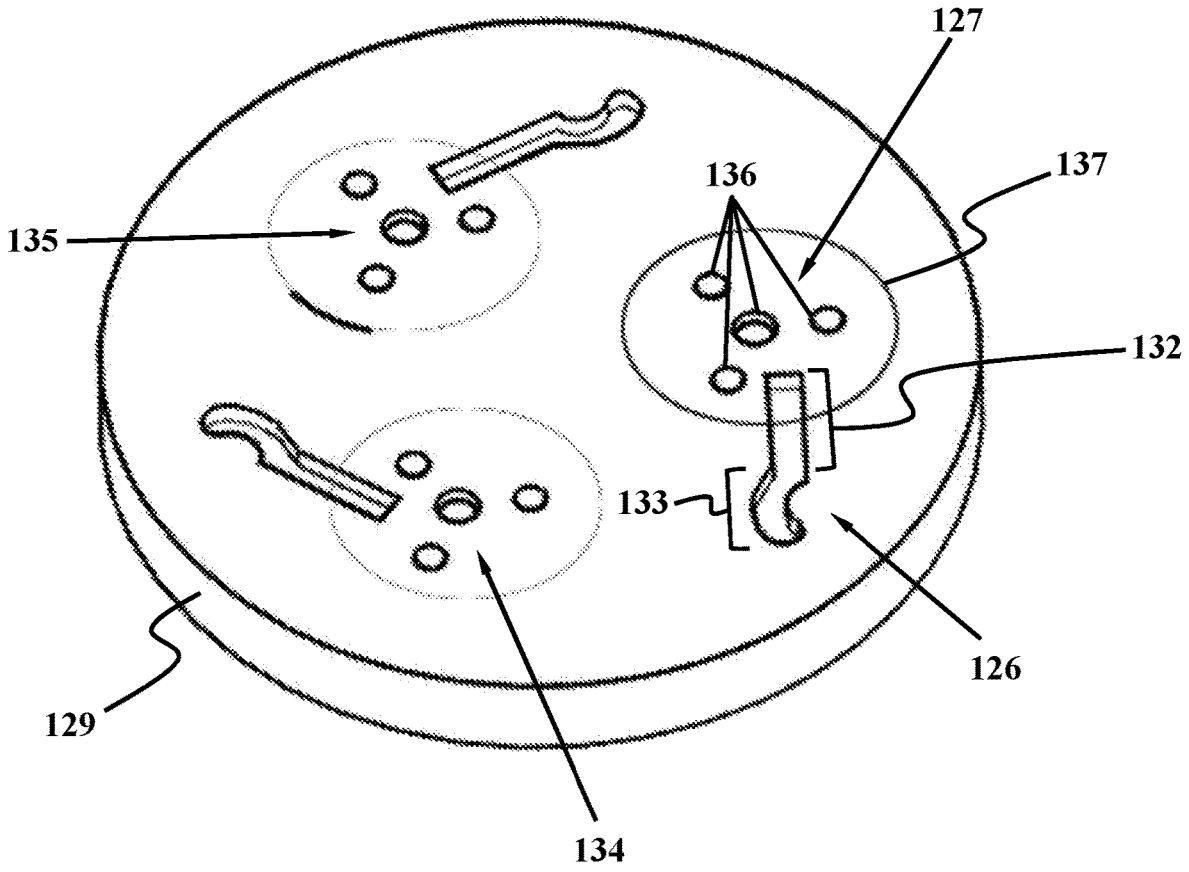
FIG. 7 illustrates a perspective view of a first cap, consistent with one or more exemplary embodiments of the present disclosure.

FIG. 7 illustrates a perspective view of first cap 130, consistent with one or more exemplary embodiments of the present disclosure. Referring to FIG. 7, each intake passage, for example, intake passage 126 may have two sections, an elongated groove section 132 and a curved groove section 133. Discharge passages 127, 134, and 135 may further be formed on first cap 130 as a number of holes under each flexible chamber. Referring to FIGS. 4 and 7, for example, holes 136 may be formed under flexible chamber 108, a base-end profile of which is shown as circle 137 in FIG. 7. Holes 136 may function as discharge passage 127 for flexible chamber 108 and holes 136 extend through the entire width of first cap 130.

Referring back to FIG. 6, once integrated flexible assembly 163 is, in an exemplary scenario, tightly placed above first cap 130 in a gas-tight attachment, the gas may only pass from above base plate 120 to an area under first cap 130 via discharge passages 127, 134, and 135.

Referring to FIG. 6, each one-way valve may be placed immediately above the curved groove section of a corresponding intake passage of a corresponding flexible chamber. For example, one-way valve 138 is immediately placed above a curved groove section 139 of intake passage 128. Referring to FIGS. 4 and 7, elongated sections of the intake passages may be extended under flexible chambers. For example, elongated section 132 of intake passage 126 may be extended under flexible chamber 108 (not visible in FIG. 7, a base end profile of which is illustrated as circle 137).

Figure 5:
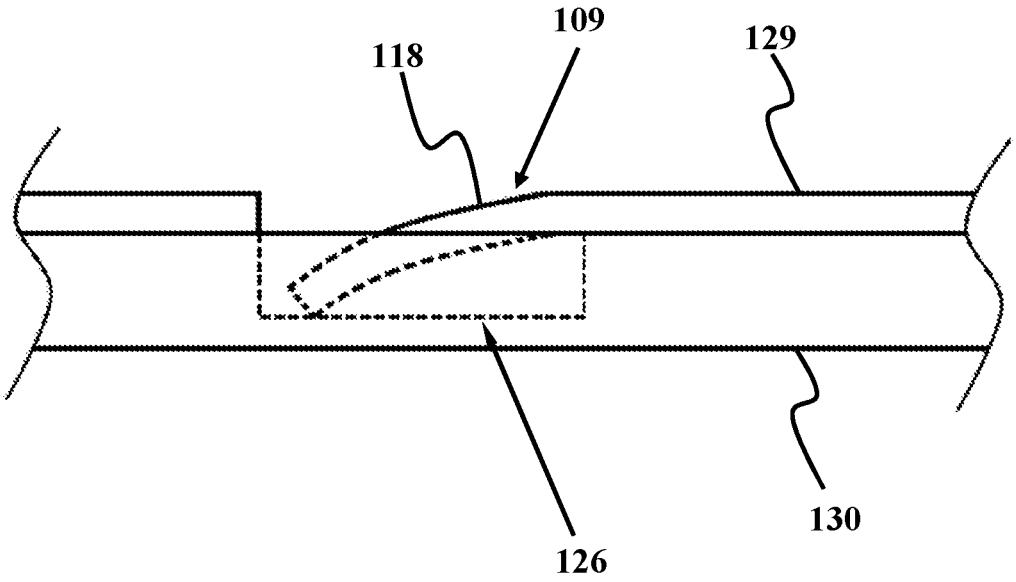
FIG. 5 shows a sectional left view of a flexible one-way valve, consistent with one or more exemplary embodiments of the present disclosure.

With reference to FIGS. 4 and 5, in an exemplary scenario, once a flexible chamber, such as flexible chamber 108 is pressed down by wobbling member 103, volume of flexible chamber 108 is reduced and the gas trapped under flexible chamber 108 may be compressed. The compressed gas may be discharged from under flexible chamber 108 through discharge passage 127, which includes holes 136 under flexible chamber 108. As wobbling member 103 continues its nutating motion, flexible chamber 108 may be pulled up by wobbling member 103, which results in an increase in the volume available under flexible chamber 108 and as a result gas is sucked into flexible chamber 108 via intake passage 126. As flexible chamber 108 is pulled up, gas will push down flexible one-way valve 109 and the gas will pass through intake passage 126 and will be trapped under flexible chamber 108. As wobbling member 103 continues its nutating motion, once again, flexible chamber 108 is pressed down. Since flexible one-way valve 109 only allows gas to be sucked into intake passage 126 and prevents gas from being pushed out from under flexible chamber 108 through intake passage 126, the only pathway available for the compressed gas is discharge passage 127.

FIG. 5 shows a sectional left view of flexible one-way valve 109, consistent with one or more exemplary embodiments of the present disclosure. Tongue 118 of flexible one-way valve 109 may bend downward as gas is being drawn into a flexible chamber, however, once the flexible chamber is pressed down by the wobbling member, since bending of tongue 118 is prohibited in an upward direction beyond the plane containing tongue 118, the gas cannot exit through intake passage 126. Referring back to FIG. 1, bending of tongue 118 may be prohibited in an upward direction beyond the plane containing tongue 118 by placing a portion of tongue 118 under wall of first chamber 141.

Figure 8:
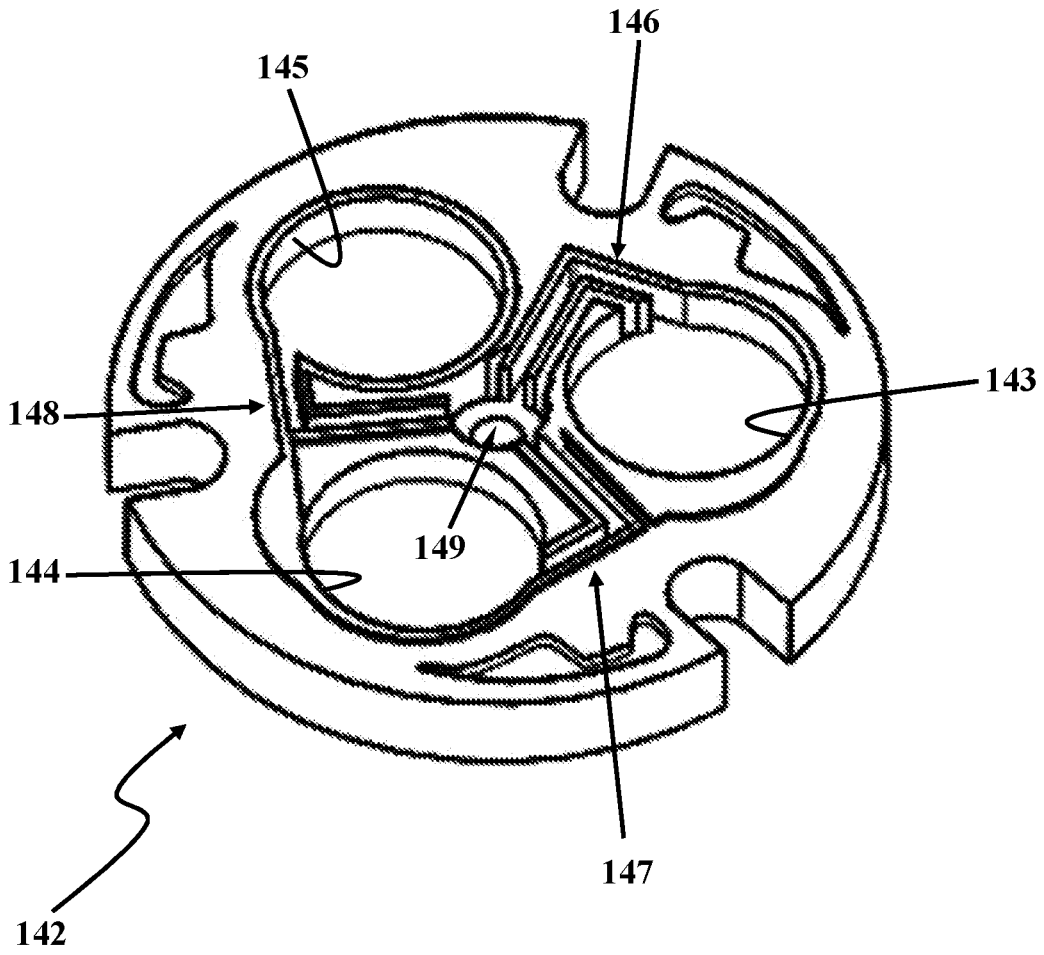
FIG. 8 illustrates a perspective view of a guiding cap, consistent with one or more the exemplary embodiments of the present disclosure.

Referring to FIG. 6, first cap 130 may be mounted on a guiding cap 142 in a gas-tight attachment. FIG. 8 illustrates a perspective view of guiding cap 142, consistent with one or more exemplary embodiments of the present disclosure. Guiding cap 142 may include a number of recessed chambers 143, 144, and 145 that may be placed under respective flexible chambers. Compressed gas that may be discharged from a discharge passage under a flexible chamber may enter a corresponding recessed chamber on guiding cap 142. After that, compressed gas gathered from all flexible chambers inside recessed chambers 143, 144, and 145 may be guided through a number of grooves 146, 147, and 148 that connect recessed chambers 143, 144, and 145 with a central hole 149 on guiding cap 142. Central hole 149 may be equipped with a one-way valve (not explicitly shown in FIG. 8) that only allows the gas to be discharged to a next compression stage.

Referring to FIGS. 4 and 8, in an exemplary scenario, recessed chamber 143 may be placed under flexible chamber 108. Compressed gas may be discharged through discharge passage 127 into recessed chamber 143 on guiding cap 142 and then it may move toward central hole 149 via groove 146 on guiding cap 142. Recessed chambers 143, 144, and 145 gather the compressed gas from all the flexible chamber and the gathered compressed gas may be guided via grooves 146, 147, and 148 to central hole 149 and compressed gas with an intermediate pressure may be sent to the next stage of compression via the one-way valve installed in central hole 149.

Figure 9:
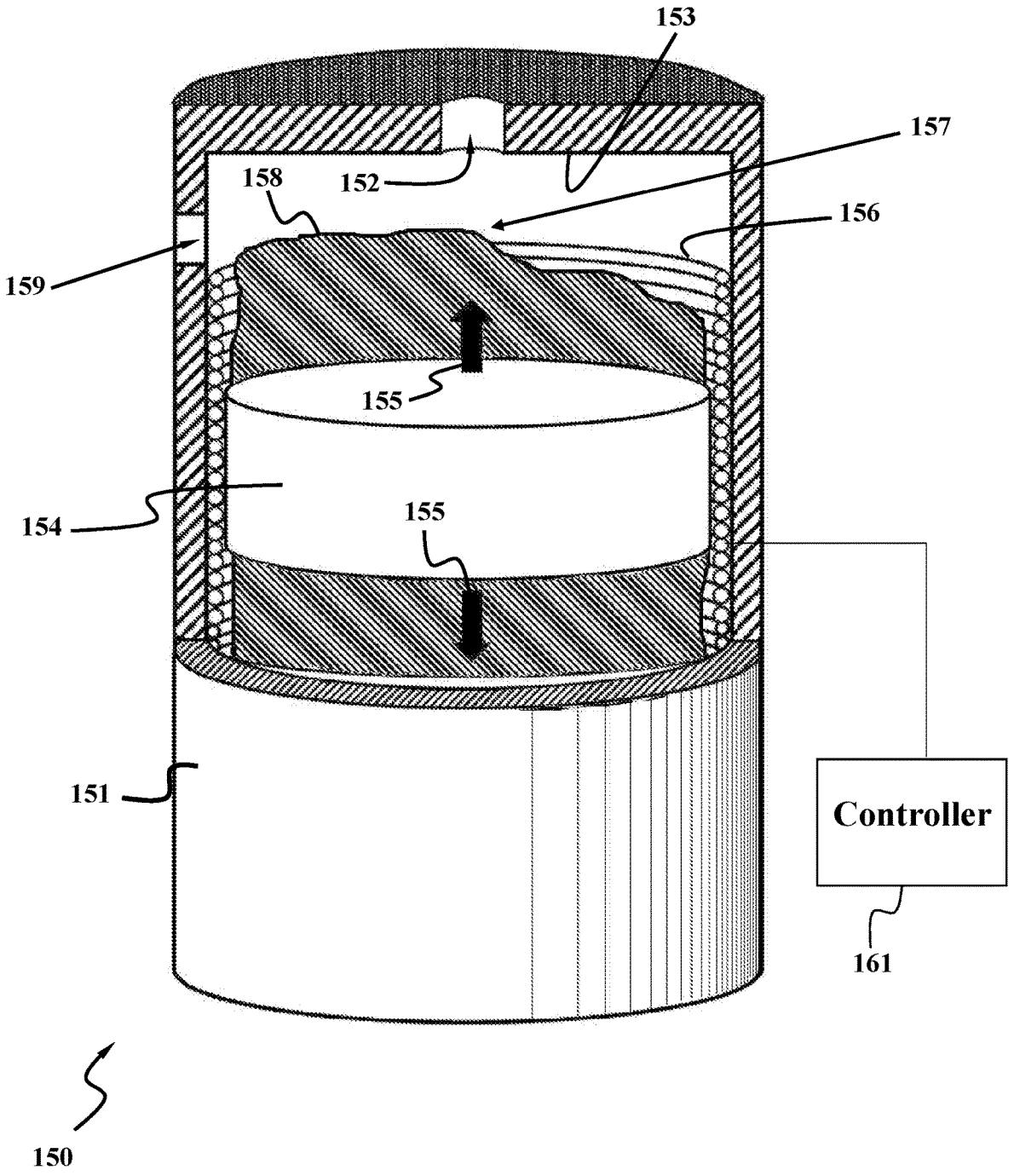
FIG. 9 illustrates a sectional perspective view of a magnetically actuated positive displacement compressor, consistent with one or more exemplary embodiments of the present disclosure.

Referring back to FIG. 1, as mentioned before, in an exemplary embodiment, multistage compressor 100 may further include second compression stage 102 that may be a magnetically actuated compression stage. FIG. 9 illustrates a sectional perspective view of a magnetically actuated compression stage 150 that may be utilized as second compression stage 102 (labeled in FIG. 1).

Referring to FIG. 9, in an exemplary embodiment, magnetically actuated compression stage 150 may include an elongated cylinder 151 with an inlet port 152 that may be formed at an end wall 153 of cylinder 151. Inlet port 152 may be in fluid communication with central hole 149 of guiding cap 142 (labeled and visible in FIG. 8). The compressed gas from the first stage may pass through a one-way valve (not visible in FIG. 9) and may enter the second stage through inlet port 152. Magnetically actuated compression stage 150 may further include a reciprocating member 154 that may be made of a permanent magnet. Reciprocating member 154 may be mounted inside elongated cylinder 151 so that reciprocating member 154 may be reciprocally movable in directions shown by arrows 155 within elongated cylinder 151.

Referring to FIG. 9, reciprocating member 154 may be driven within elongated cylinder 151 by a magnetic linear actuator. The magnetic linear actuator may include a winding 156 that is wound about a bobbin 157 (a section of an inner surface 158 of bobbin is illustrated in FIG. 9). It should be understood that only a portion of wound wires are illustrated in FIG. 9 for simplicity. Winding 156 may be connected to a controller 161 that may be programmed to energize winding 156 and sequentially change positive and negative poles of winding 156 thereby causing reciprocating member 154 to be driven up and down.

With further reference to FIG. 9, in an exemplary embodiment, reciprocating member 154 may have a generally circular cross-section, such that reciprocating member 154 sealably engages inner surface 158 of bobbin 157. According to an exemplary implementation, reciprocating member 154 may be in a form of a permanent magnet interposed and sealed between supporting elements. Reciprocating member 154 should be slidable across inner surface 158 of bobbin 157 so that reciprocating member 154 moves freely up and down in elongated cylinder 151. At the same time, the circumferential edges of reciprocating member 154 must provide a secure seal.

In an exemplary scenario, once the compressed gas from the first stage is introduced into elongated cylinder 151 through inlet port 152, winding 156 may be energized by controller 161 such that reciprocating member 154 may be pulled down and the volume of elongated cylinder 151 may increase, whereby compressed gas from the first compression stage may be drawn into the cylinder 151. When controller 161 changes positive and negative poles of winding 156, reciprocating member 154 reverses direction and may be driven upward and the volume of cylinder 151 decreases thereby the compressed gas may be further compressed in the second stage from the intermediate pressure to the second higher pressure. The high pressure gas may exit through an outlet port 159 formed on a side wall of cylinder 151.

Figure 10:
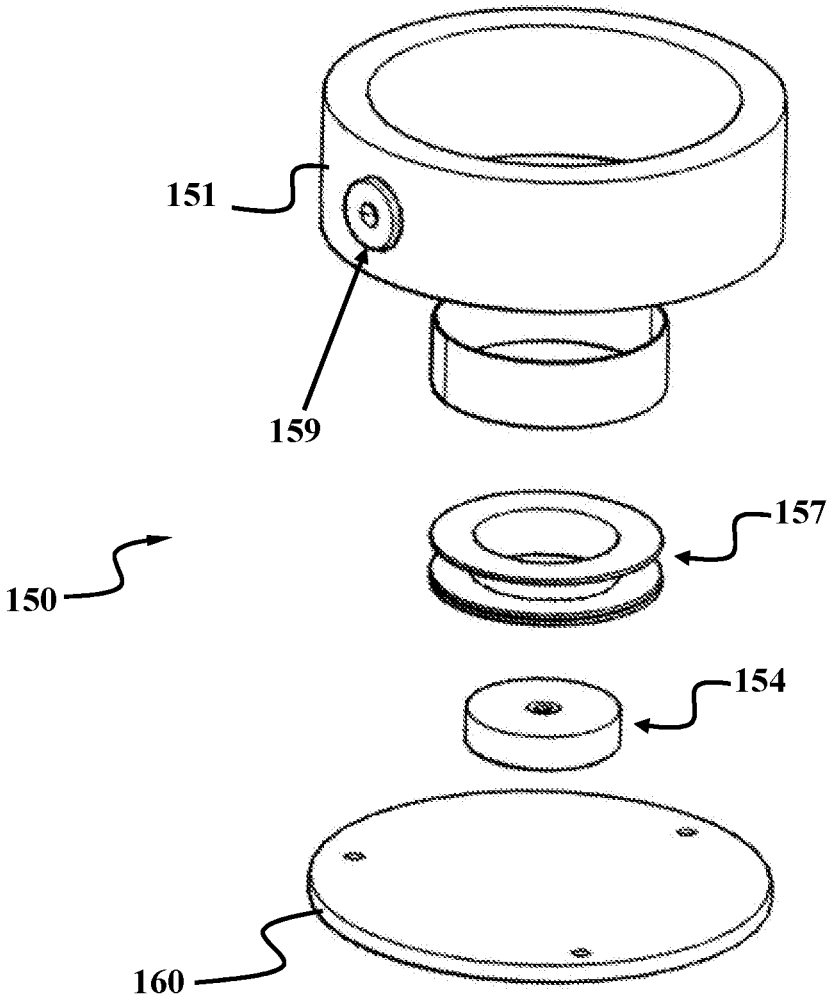
FIG. 10 illustrates an exploded view of a magnetically driven compressor, consistent with one or more exemplary embodiments of the present disclosure.

FIG. 10 illustrates an exploded view of magnetically actuated compression stage 150, consistent with one or more exemplary embodiments of the present disclosure. Referring to FIG. 10, second magnetically actuated compression stage may include elongated cylinder 151 with outlet port 159 formed on a side wall thereof and reciprocating member 154 disposed within bobbin 157. Bobbin 157 may be a cylinder with flanges on which wire may be wound to from winding 156. According to other embodiments, bobbin 157 may be without flanges. Reciprocating member 154 may be reciprocally movable inside bobbin 157.

Referring to FIGS. 9 and 10, according to one exemplary embodiment, elongated cylinder 151 may be formed without top end wall 153. A base end wall 160 may be attached to elongated cylinder 151 and guiding cap 142 may be mounted on top of elongated cylinder 151 in a gas-tight manner to form the second compression stage.

While the foregoing has described what are considered to be the best mode and/or other examples, it is understood that various modifications may be made therein and that the subject matter disclosed herein may be implemented in various forms and examples, and that the teachings may be applied in numerous applications, only some of which have been described herein. It is intended by the following claims to claim any and all applications, modifications and variations that fall within the true scope of the present teachings.

Unless otherwise stated, all measurements, values, ratings, positions, magnitudes, sizes, and other specifications that are set forth in this specification, including in the claims that follow, are approximate, not exact. They are intended to have a reasonable range that is consistent with the functions to which they relate and with what is customary in the art to which they pertain.

The scope of protection is limited solely by the claims that now follow. That scope is intended and should be interpreted to be as broad as is consistent with the ordinary meaning of the language that is used in the claims when interpreted in light of this specification and the prosecution history that follows and to encompass all structural and functional equivalents. Notwithstanding, none of the claims are intended to embrace subject matter that fails to satisfy the requirement of Sections 101, 102, or 103 of the Patent Act, nor should they be interpreted in such a way. Any unintended embracement of such subject matter is hereby disclaimed.

Except as stated immediately above, nothing that has been stated or illustrated is intended or should be interpreted to cause a dedication of any component, step, feature, object, benefit, advantage, or equivalent to the public, regardless of whether it is or is not recited in the claims.

It will be understood that the terms and expressions used herein have the ordinary meaning as is accorded to such terms and expressions with respect to their corresponding respective areas of inquiry and study except where specific meanings have otherwise been set forth herein. Relational terms such as first and second and the like may be used solely to distinguish one entity or action from another without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "a" or "an" does not, without further constraints, preclude the existence of additional identical elements in the process, method, article, or apparatus that comprises the element.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various implementations. This is for purposes of streamlining the disclosure, and is not to be interpreted as reflecting an intention that the claimed implementations require more features than are expressly recited in each claim. Rather, as the following claims reflect, inventive subject matter lies in less than all features of a single disclosed implementation. Thus, the following claims are hereby incorporated into the Detailed Description, with each claim standing on its own as a separately claimed subject matter.

While various implementations have been described, the description is intended to be exemplary, rather than limiting and it will be apparent to those of ordinary skill in the art that many more implementations and implementations are possible that are within the scope of the implementations. Although many possible combinations of features are shown in the accompanying figures and discussed in this detailed description, many other combinations of the disclosed features are possible. Any feature of any implementation may be used in combination with or substituted for any other feature or element in any other implementation unless specifically restricted. Therefore, it will be understood that any of the features shown and/or discussed in the present disclosure may be implemented together in any suitable combination. Accordingly, the implementations are not to be restricted except in light of the attached claims and their equivalents. Also, various modifications and changes may be made within the scope of the attached claims.

What is claimed is:

1. A multistage compressor, comprising:

a wobbling member operationally coupled with an external power source configured to drive a nutating motion of the wobbling member;

a plurality of flexible chambers connected to the wobbling member, wherein each flexible chamber of the plurality of flexible chambers including a respective intake passage and a respective discharge passage, wherein each respective intake passage containing a respective one-way valve, the wobbling member configured to sequentially press down and pull up the plurality of flexible chambers, responsive to the wobbling member pulling up each flexible chamber, gas is drawn into each flexible chamber through the respective one-way valve of each flexible chamber, responsive to the wobbling member pressing down each flexible chamber, the drawn gas is compressed to a higher pressure and discharged through the respective discharge passage of each flexible chamber; and a magnetically actuated compression stage, wherein the magnetically actuated compression stage is configured to receive the compressed gas discharged from the flexible chambers, wherein the magnetically actuated compression stage comprises:

an elongated cylinder with an inlet port and an outlet port;

a bobbin disposed inside the elongated cylinder;

a reciprocating member mounted configured to reciprocate in the bobbin, wherein the reciprocating member includes a permanent magnet, wherein the reciprocating member sealably engaged with an inner surface of the bobbin; and a controller coupled with the bobbin configured to sequentially change polarity of the bobbin to generate a reciprocating magnetic field that is configured to drive the permanent magnet reciprocally through the elongated cylinder such that the compressed gas is alternatively drawn into the elongated cylinder from the inlet port and is further compressed and discharged from the outlet port.

2. The multistage compressor according to claim 1, wherein the wobbling member includes a plurality of extended tongues, and wherein each flexible chamber of the plurality of flexible chambers is attached to a corresponding extended tongue of the plurality of extended tongues.

3. The multistage compressor according to claim 2, wherein the plurality of extended tongues include three extended tongues spaced apart by 120°.

4. The multistage compressor according to claim 1, wherein the wobbling member includes a disk, and wherein each flexible chamber of the plurality of flexible chambers is attached to periphery of the disk.

5. The multistage compressor according to claim 1, wherein the wobbling member includes a disk, and wherein three flexible chambers are attached to periphery of the disk spaced apart by 120°.

6. The multistage compressor according to claim 1, wherein the flexible chambers share a flange in a form of a base plate.

7. The multistage compressor according to claim 6, wherein the one-way valve of each flexible chamber is integrally formed on the base plate.

8. The multistage compressor according to claim 7, wherein the one-way valve of each flexible chamber includes a flexible tongue bendable in one direction, and wherein the flexible tongue is cut into the base plate.

9. The multistage compressor according to claim 7, wherein the flexible chambers, the base plate, and the one-way valves are formed as an integrated flexible assembly out of a flexible material.

10. The multistage compressor according to claim 9, wherein the intake passage and the discharge passage of each flexible chamber are formed on a first cap, and wherein the first cap is attached sealably and immediately under the integrated flexible assembly.

11. The multistage compressor according to claim 1, wherein the plurality of flexible chambers include flexible cups made of a flexible polymeric material.

* * * * *